United States Patent [19]

Jackson et al.

[11] 4,442,332

[45] Apr. 10, 1984

[54] HEAT TREATMENT OF ROTATIONALLY SYMMETRICAL WORKPIECES BY INDUCTION HEATING

[75] Inventors: William B. Jackson, Wirral; Ian G. Harvey, Upton by Chester; Philip H. Warren, Chester, all of England

[73] Assignee: The Electricity Council, England

[21] Appl. No.: 282,901

[22] Filed: Jul. 13, 1981

[51] Int. Cl.[3] ..... H05B 6/10

[52] U.S. Cl. ..... 219/10.67; 219/10.41; 219/10.57; 219/10.69

[58] Field of Search ..... 219/10.67, 10.69, 10.71, 219/10.73, 10.57, 10.49, 10.41, 10.43

[56] References Cited

U.S. PATENT DOCUMENTS

| | | | |
|---|---|---|---|
| 2,299,934 | 10/1942 | Sherman et al. | 219/10.67 |
| 2,422,417 | 6/1947 | Hutchinson | 219/10.69 |
| 3,051,811 | 8/1962 | Koesling | 219/10.67 |
| 3,251,976 | 5/1966 | McBrien | 219/10.43 |
| 3,396,258 | 8/1968 | Leatherman | 219/10.43 |
| 3,846,609 | 11/1974 | Enk | 219/10.43 |
| 4,082,936 | 4/1978 | Aoki et al. | 219/10.57 |
| 4,184,798 | 1/1980 | Laughlin | 219/10.67 |
| 4,288,673 | 9/1981 | Ishibashi | 219/10.79 |
| 4,348,571 | 9/1982 | Dills | 219/10.67 |

*Primary Examiner*—B. A. Reynolds
*Assistant Examiner*—Marvin M. Lateef
*Attorney, Agent, or Firm*—Beveridge, De Grandi & Kline

[57] ABSTRACT

In the induction heating of rotationally symmetrical workpieces, the workpieces are passed through the treatment region with magnetic flux in the region parallel to the axis of symmetry of each workpiece as it passes through the treatment region. In order to obtain uniform heating of the workpieces, flux modifying members are provided which are arranged so that the resultant distribution, across the workpiece transversely of the axis thereof of the magnetic flux density in the axial direction is substantially inversely related to the distance from the axis of rotational symmetry of the workpiece.

27 Claims, 11 Drawing Figures

FIG. 1.
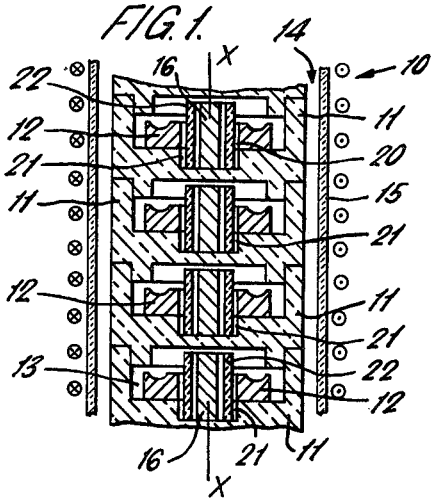
FIG. 2.
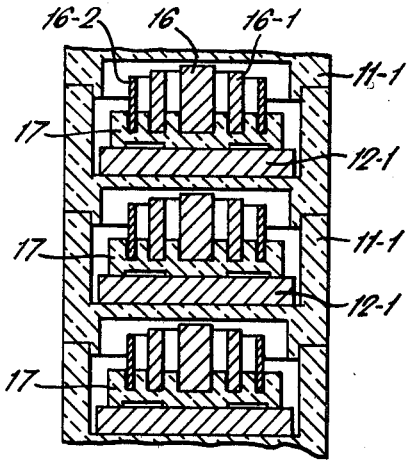
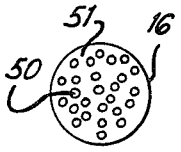
FIG. 11.
FIG. 3.
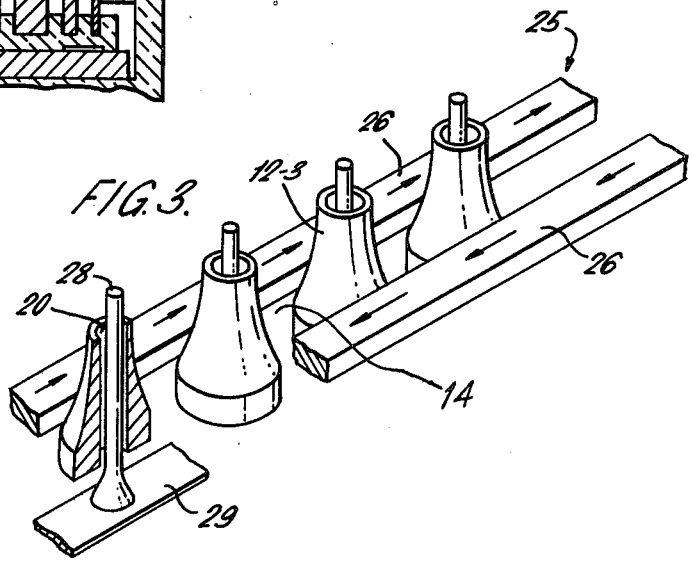

HEAT TREATMENT OF ROTATIONALLY SYMMETRICAL WORKPIECES BY INDUCTION HEATING

BACKGROUND OF THE INVENTION

This invention relates to heat treatment of rotationally symmetrical workpieces by induction heating.

It is known to heat treat workpieces by passing them in abutting relationship through the treatment region of an elongate induction heating apparatus or furnace where the workpieces become heated by means of the eddy currents induced in them. However, induced eddy currents themselves act to modify the original flux distribution in the treatment region of the apparatus, and the effect of the abutting workpieces within this treatment region is to modify the original flux distribution to such an extent that most of the induced currents are confined to the outer regions of the workpieces, thus giving rise to a very non-uniform heating pattern within the workpieces.

For these reasons, the usual practice has been to rely on thermal conduction for the heat to diffuse through the workpiece to enable a uniform temperature to be reached. This takes time and leads to slow and inefficient operation.

SUMMARY OF THE INVENTION

According to the present invention there is provided a method of heat treating a rotationally symmetrical workpiece by induction heating comprising mounting the workpiece on a refractory transport means and passing the transport means longitudinally through an elongate treatment region of an induction heating apparatus with the axis of symmetry of the workpiece parallel to the magnetic flux of the heating apparatus, the workpiece being accompanied on at least part of its passage through the treatment region by at least one flux modifying member which acts to modify the magnetic flux distribution by the effects of the eddy currents induced in that member and/or its magnetic permeability so that the resultant distribution across the workpiece transversely to the axis thereof of the flux density in the axial direction is substantially inversely related to the distance from the axis of rotational symmetry of the workpiece. As will be further explained later, this distribution of the axial flux density leads to uniform heating of a rotationally symmetrical article.

The coil systems may be axially symmetrical. In some cases however it is preferred to use a long coil along which the workpiece is moved. The required flux density distribution is substantially achieved across the workpiece although the eddy currents no longer flow in purely circular paths. From the practical point of view however, the requirement is that the average flux density around any periphery line should be inversely proportional to the radius. This can readily be achieved by rotating the workpiece during the heating cycle. Thus if there are local perturbations in the heating intensity around the workpiece, it is readily possible to reduce them to an acceptable level by merely rotating the workpiece. Uniform heating in general leads to a substantially uniform temperature through the workpiece. It is not necessary to rely on the slow process of thermal diffusion to even out temperature variations. This leads to a further important advantage in that the heating time is reduced. For example the heating to forging temperature of a 70 mm diameter steel workpiece by conventional induction means takes about 200 secs. With the technique described above, the heating time may be reduced to about 20 secs. A rotational speed of 12 rpm would give four complete revolutions for averaging out any peripheral non-uniformities if the coil system is not axially symmetrical. With the uniform heating given by the method of the present invention, it is readily possible therefore to effect a desired heat treatment of rotationally symmetrical articles rapidly and without overheating any parts of the workpiece. This is particularly important in heating workpieces of pressed metal powder preforms in a sintering operation since non-uniform heating results in thermal distortion of the preforms.

The invention furthermore includes within its scope a method of heat treating rotationally symmetrical workpieces by induction heating comprising mounting the workpieces spaced apart along a refractory (preferably ceramic) transport means and passing the transport means longitudinally through an elongate treatment region of an induction heating apparatus with the axis of symmetry of the workpieces parallel to the magnetic flux of the heating apparatus, there being a multiplicity of workpieces in the treatment region at any one time, each workpiece being accompanied on at least part of its passage through the treatment region by at least one flux modifying member which acts to modify the magnetic flux distribution by the combined effects of the eddy currents induced in that member and/or its magnetic permeability so that the resultant distribution across the workpiece transversely to the axis thereof of the flux density in the axial direction is substantially inversely related to the distance from the axis of rotational symmetry of the workpiece. By this method each workpiece is heat-treated without substantial interference from its neighbouring workpieces. In other words, as compared to passing the workpieces through the treatment region with the workpieces in abutting relationship, there is a reduction in the amount of heat transfer from neighbouring workpieces and a reduction in the disturbance of the flux through the workpiece, this flux disturbance being due to the eddy currents in neighbouring workpieces.

The present invention also provides an induction heating apparatus for the heat treatment of a rotationally symmetrical workpiece passed through an elongate treatment region thereof, comprising a refractory transport means movable longitudinally through the treatment region, said transport means being arranged to carry the workpiece with its axis of symmetry in a predetermined direction with respect to the transport means, means for producing an alternating magnetic flux in said treatment region with the flux parallel to the axis of symmetry of the workpiece, flux modifying members arranged to accompany the workpiece in predetermined positions with respect thereto on at least part of its passage through the treatment region, which modifying members act to modify the flux in the treatment region by the effects of the eddy currents induced in said members and/or their magnetic permeability so that the resultant distribution across the workpiece transversely to the axis thereof of the flux density in the axial direction is substantially inversely related to the distance from the axis of rotational symmetry of the workpiece.

A plurality of workpieces may be passed sequentially through an elongate treatment region of the apparatus.

The workpieces may be spaced apart by the use of spacers which are non-conductive. Alternatively, the workpieces can be moved by a transport means arranged to carry the workpieces at predetermined spaced positions. One form of such a transport means comprises a multiplicity of non-conductive elements arranged to be fitted together in a line, and formed so as to provide respective cavities for receiving the workpieces. Such an arrangement is particularly useful in connection with vertically disposed treatment regions since the elements fit one on top of another as a tower and thus possess an inherent stability. A further advantage of separating workpieces in such vertical treatment regions is that the workpieces at the bottom of the pile would otherwise have to support the weight of those above them and the compressive force between adjacent workpieces can result in the workpieces becoming welded together. For this reason it is known to feed cold workpieces in at the bottom of the treatment region so that as they move upwards and get hotter this force is progressively reduced. Such an arrangement places undesirable constraints on the flow of a controlled atmosphere through the treatment region however and the use of the elements obviates both problems simultaneously.

When the heating coil of the apparatus is of the flat-coil type and is elongate, the treatment region being that region between the spaced elongate portions of the coil, an alternative form of transport means may be used comprising a movable body of non-conductive material including mounting means arranged to mount workpieces at predetermined spaced apart positions. For workpieces which have a cavity or a through passage, the mounting means may be in the form of respective posts which may be fixed to the body or located within respective recesses in the body.

Preferably, the workpieces are passed through the treatment region in such a manner that neither the workpieces nor the spacers (or the transport means) come into contact with a refractory lining of the induction heating apparatus. Such linings are used to reduce the heat loss from the workpieces, thereby improving the efficiency of the heat treatment and protecting the heating coil from radiation from the hot workpieces. By ensuring that there is no mechanical contact with the lining, it can be made thinner and/or of less strong or durable material and thus more cheaply as compared with known apparatuses wherein the lining has to be able to withstand knocks and scrapes from hot workpieces. In an apparatus having a transport means, the workpieces are constrained to travel at their respective predetermined positions relative to the transport means, and the above-mentioned avoidance of contact with the refractory lining can be achieved by the use of guide means arranged to limit movement of the transport means in a transverse direction as it passes through the treatment region.

To improve the efficiency and uniformity of the heating of the workpieces, each workpiece is accompanied on at least a part of its passage through the treatment region by at least one flux modifying member which acts to modify the magnetic flux distribution by the combined effects of the eddy currents induced in that member and its magnetic permeability. The positioning of such a member will depend upon the particular workpiece to be heat treated, for instance where the workpiece has a bore a member may be disposed within the bore. Such member can be arranged extending between adjacent workpieces, longitudinally of the treatment region.

For the purpose of the present invention, a flux modifying member can be made of a magnetic material having high resistivity, such as the material forming iron dust cores in I.F. transformers. It can also be made of an electrically conductive material, in which case it is not necessary for it to have any significant magnetic permeability, the flux modifying effect being obtained by the combined effects of eddying currents induced in the material, and of its magnetic permeability, if of significant value. It will thus be appreciated that a suitable material will possess significant magnetic permeability and/or electrical conductivity.

In the case where the mounting means of an above-mentioned transport means is in the form of posts, these posts can be made of magnetic material and thereby constitute flux modifying members for modifying the magnetic flux distribution.

It may be necessary to position thermally insulating material between the workpieces and magnetic flux modifying members to reduce or prevent heating of the magnetic material by the workpieces to a temperature above its Curie temperature.

The flux modifying members may be cooled by passing a coolant through and/or over the members.

A pressed powder technique may be used to form magnetic flux modifying members from say, iron dust, preferably mixed with magnetite to reduce the conductivity of the material. The relative permeability of such a pressed powder member is generally in the range 20–30. Alternatively, the flux modifying member can be made by the steps of forming a bundle of strands of a high permeability/low conductivity material and encapsulating the bundle, i.e. filling the interstices with a substance to hold the strands in position. Preferably a non-conductive encapsulant is used, for example a ceramic cement. The material of the strands can be that known by the trade name "Kanthal", or that known by the trade name "Aluchrome", or a similar material, particularly the ferritic stainless steels commonly used in the manufacture of heating elements.

The bundle of strands can be formed into a desired shape prior to their encapsulation, or the final article can be cut or machined from a preformed block of the material.

BRIEF DESCRIPTION OF THE DRAWINGS

FIG. 1 is a schematic sectional diagram showing spaced workpieces travelling vertically through a solenoid induction heating coil;

FIG. 2 illustrates a modification of the arrangement of FIG. 1;

FIG. 3 shows spaced workpieces travelling horizontally through the treatment region of an elongate flat heating coil;

FIG. 11 is a sectional view through a flux modifier.

DESCRIPTION OF THE PREFERRED EMBODIMENT

Figure 4:
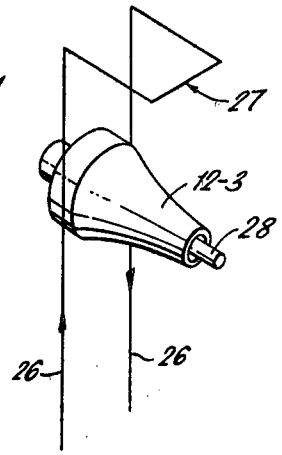
FIG. 4 shows schematically the heating coil of FIG. 3 disposed vertically.

In FIG. 1 there is shown schematically a vertically disposed solenoid heating coil 10 of an induction heating apparatus, the remainder of which apparatus is not shown. A column of spacing elements 11, each of which carries a workpiece 12 within a cavity 13 thereof, travels longitudinally within the elongate treatment region 14 inside an optional refractory lining 15 adjacent the heating coil 10. The spacing elements 11 have apertures (not shown) to permit access to the cavities 13 of a controlled atmosphere in the induction heating apparatus.

The spacing elements are formed of a non-conductive material, for example a ceramic material, in order to avoid direct eddy current heating of the elements which otherwise would heat the workpiece by radiation and conduction and could cause an undesirable distribution of heat in the workpiece in addition to reducing the overall efficiency of heating.

The workpieces 12 are spaced apart in the longitudinal direction of the heating coil 10 by approximately twice their greatest dimension, and under these conditions there is a worthwhile improvement in flux distribution at a workpiece compared with when the workpieces 12 are stacked one on top of another. The greater the spacing of the workpieces 12, the less the effect a workpiece has on its neighbouring workpieces, but the lower is the efficiency with poorer utilisation of the inducing magnetic field.

The upper and lower portions of the spacing elements 11 have complementary formations, the upper portion having a rim and the lower portion having a peripheral recess for receiving such a rim, thus enabling the spacing elements to be securely fitted together. The column thus formed is very stable and is readily driven through the treatment region without coming into contact with the refractory lining 15.

It will be noted that each workpiece 12 rests on the bottom of a respective recess cavity 13 but that there is a clearance between the top of the workpiece and the bottom of the immediately above spacing element 11. There is thus no compressive force on the workpieces. For a larger workpiece the recess cavity 13 can be made deeper as a deeper recess and/or a similar recess cavity can be provided in the lower surface of the spacing element.

In FIG. 1, each workpiece 12 is in the shape of a cylinder, with a central bore 20. In the particular workpiece illustrated, the axial length is of the same order as its radius. Each workpiece has an associated magnetic core 16 to modify the flux distribution. Each magnetic core 16 is mounted in a ceramic spacer 11 to avoid direct contact between the core and the workpiece. The axial length of the magnetic cores 16 is selected such that the top of the magnetic core 16 is just below the underside of the adjacent spacing element. The magnetic cores 16 are arranged approximately symmetrical with respect to the median transverse planes of the workpieces. The magnetic cores 16 extend longitudinally through the bores 20 of the workpieces with their lower ends located in respective recesses 21 in the spacing elements 11. The cores are protected from direct contact with the workpieces by a ceramic sleeve 22. The dimensions of the spacing elements and of the cores are selected such that the cores are positioned symmetrically in relation to the median planes of the workpieces, and preferably such that there is effectively a continuous magnetic core extending through the treatment region.

It can be shown that uniform heating of a thin flat disc (or indeed any rotationally symmetrical body) is obtained when the axial flux density varies inversely with the radius of the disc. The magnetic flux is parallel to the axis of the symmetry X—X of each workpiece as it passes through the treatment region. It does not matter how the flux is distributed within the hole 20 in the centre of the workpiece provided it is related to the distribution outside it. It can be shown that this requirement is satisfied by a theoretical constant flux density across the bore hole equal to twice the value required at the edge of the hole. It is therefore certainly not necessary to produce an infinite flux density at $r=0$ in order to realise the uniform heating condition. A suitably sized magnetic core is an ideal way of achieving this.

It is important to obtain uniform heating of workpieces made of pressed metal powder since, if the comparatively weak pressed powders are not heated uniformly, there is considerable danger of thermal distortion in the preform during the sintering process leading to poorer dimensional tolerances and possible weakness in the final product.

As has been mentioned, the magnetic cores may themselves become heated by induced eddy currents, and thermally insulating sleeves are used to prevent radiation from the cores to the workpieces. However, more commonly the material of the magnetic cores will have a low conductance and there will be no significant eddy current heating of the cores, but it will still be desirable to use the insulating sleeves to reduce heating of the cores by the hot workpieces so that the magnetic material does not exceed its Curie temperature.

FIG. 2 shows a construction with flat disc workpieces 12-1 carried in spacers 11-1.

Each magnetic core 16 is mounted in a ceramic spacer 17 to avoid direct contact between the core 16 and workpiece 12-1. Also mounted in the spacer 17 are spaced concentric hollow cylinders 16-1 and 16-2 which are formed of ferromagnetic material and also act as cores. The cores are arranged to be approximately symmetrical with respect to the median transverse planes of the workpieces and are dimensioned to give the required flux density distribution varying inversely with radius from the centre. In FIG. 2, workpieces 12-1 are illustrated which do not have a central aperture. Strictly, if the flux density distribution is to vary inversely with radius, it would have to be infinite at the centre of the workpiece. However, this infinite flux density is required only in an infinitely small region and the total amount of flux required remains finite. A very small actual region may experience a low heating intensity but the required temperature distribution is achieved by thermal diffusion and, in practice, the techniques of the present invention is satisfactory for such a workpiece.

Figure 5:
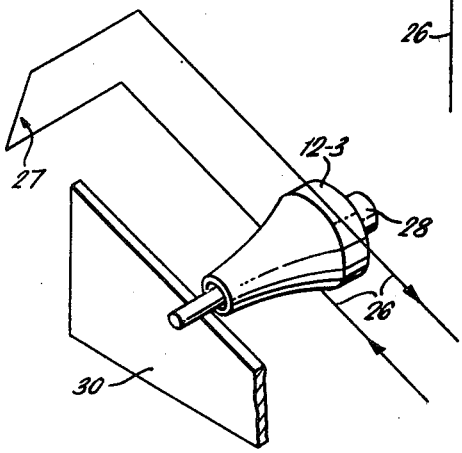
FIG. 5 shows schematically the heating coil of FIG. 3 inclined.

FIG. 3 shows an alternative form of heating coil 25 which is wound as a flat coil having two long spaced parallel portions 26 and two short end portions 27 (see FIGS. 4 and 5). Such a coil is known as a hairpin coil. The region between coil portions 26 is the treatment region 14 through which workpieces 12-3 are moved. These workpieces 12-3 have a through bore 20 and are mounted on respective posts 28 spaced along and fixed to an endless transport mechanism 29.

Again, to improve the efficiency and uniformity of the heat treatment, the flux distribution is modified by forming the posts 28 of a magnetic material. The posts constitute magnetic cores and are preferably thermally isolated from the workpieces as discussed later. It will be appreciated that the posts 28 prevent the workpieces from wandering into contact with the refractory lining (not shown) for the coil portions 26. The posts 28 are shaped to ensure that the resultant average flux density distribution is substantially inversely proportional to the radius.

The flat coil 25 is not limited to a horizontal configuration and can be arranged vertically as shown in FIG. 4, or sloping as in FIG. 5. In FIGS. 4 and 5 the end portions 27 are shown displaced from the plane of the long coil portions 26 so as to provide open ends for the treatment region and facilitate the entry and exit of the workpieces. It will be observed that the axes of those posts 28 in the treatment region are at right angles to the plane of coil portions 26 and to the longitudinal direction of the treatment chamber. Thus if required the workpieces 12-3 can be rotated about the posts 28 to render more uniform the heating of the workpieces. A simple method of rotating the workpieces 12-3 is to press the workpieces against a stationary surface having a high coefficient of friction relative to the material of the workpieces whereby the workpieces roll along this stationary surface. The upper surface of ramp 30 shown in FIG. 5 can constitute this stationary surface. If a greater rate of rotation is required this surface can be moved in the opposite direction to the movement of the transport mechanism 29. Alternatively the post can be rotated by contact with ramp 30, the workpiece being rotated by frictional engagement with the post.

Figure 6:
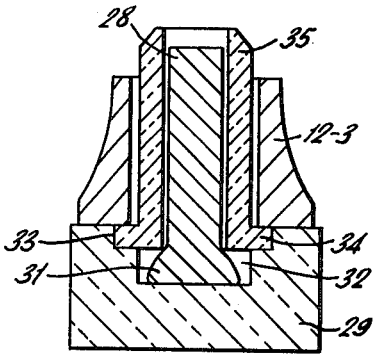
FIG. 6 is a sectional view of a workpiece mounted on a transport means.

Normally the posts 28 (and the cores 16) will be formed of a material of high permeability and low conductance in order to obtain modification of the flux distribution without this material itself becoming heated by eddy currents induced therein. If a material is used for the posts 28 which has substantial conductance, it may be necessary to prevent direct heating of the workpiece by the post, and this can be achieved by the use of thermal insulation suitably positioned. One form of such insulation is shown in FIG. 6 which is a transverse section through the transport mechanism 29 of FIG. 3 but incorporating a slight modification. A post 28 is shown with its base 31 fixed to the bottom of a recess 32 in the transport mechanism 29. At the top of the recess 32 is an annular rebate 33 in which is located an annular flange 34 at the lower end of a thermally insulating sleeve 35 fitting over the post 28. The workpiece 12-3 is disposed around the sleeve 35.

Figure 7:
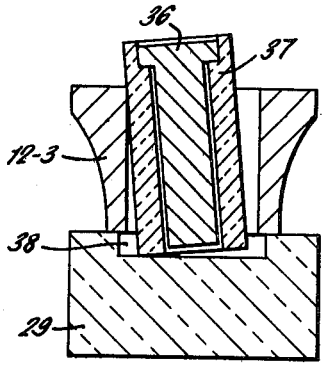
FIG. 7 is a sectional view of a workpiece differently mounted on a transport means.

FIG. 7 is a similar section through an alternative arrangement in which instead of a post 28 fixed to the transport mechanism 29, there is a separate magnetic core 36 fitted within a thermally insulating sleeve 37 whose lower end is located in a recess 38 in the transport mechanism. In use the core 36 and sleeve 37 are simply inserted through the bore in the workpiece to rest in the recess 38.

If required a magnetic core can be formed of a first part fixed in the manner of post 28, and a second part separate from the first part and arranged to provide an air gap between the parts. The relative positions of the parts can be altered to obtain control of the air gap.

Figure 8:
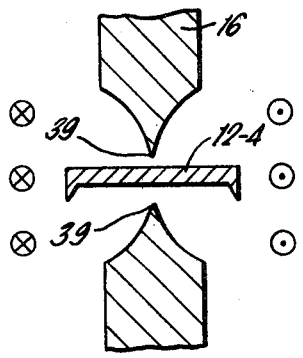
FIG. 8 shows schematically a particular shaping of magnetic cores to obtain the desired flux distribution in a flat workpiece in accordance with the present invention.

FIG. 8 illustrates the shaping of magnetic cores 16 necessary for obtaining near uniform heat treatment of a thin flat disc 12-4. The pointed ends 39 of the magnetic cores provide a distribution which is a close approximation to the ideal desired distribution.

Figure 9:
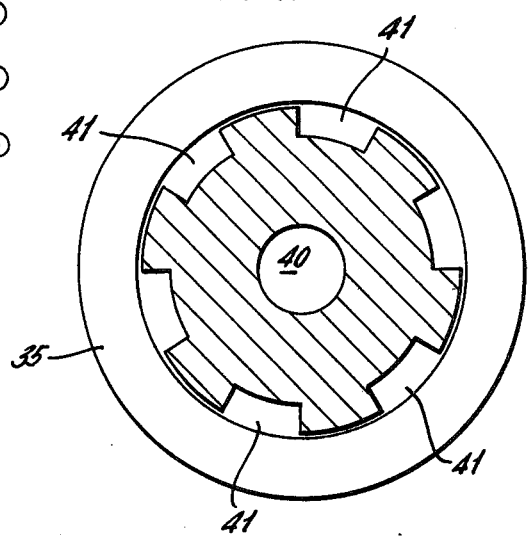
FIGS. 9 and 10 are transverse sectional views through a magnetic core and a refractory sleeve showing respective arrangements of ducts for the flow of coolant.

In the situation where the workpiece is raised to a high temperature and the material of the magnetic core is one which becomes heated by eddy currents induced therein, the magnetic core is continuously cooled by passing a coolant gas through longitudinal ducts 40. As shown in FIG. 9 the magnetic core has a first duct 40 in the form of an axial bore, and has six longitudinal channels 41 regularly spaced around its cylindrical surface, which channels in conjunction with the inner surface of the insulating sleeve 35 constitute further ducts 40.

Figure 10:
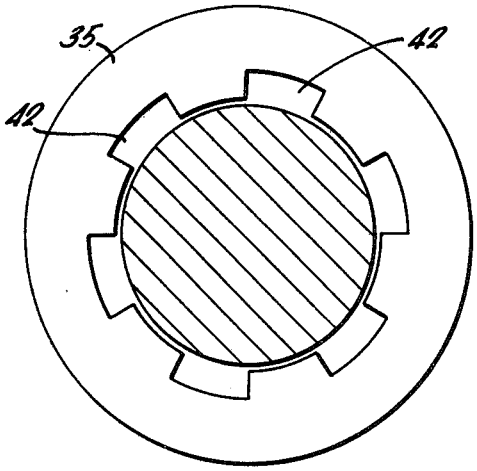

FIG. 10 shows an alternative arrangement in which longitudinal channels 42 are formed in the inner surface of the sleeve 35 and in conjunction with the cylindrical surface of the magnetic core constitute ducts. If required the ducts may be formed by channels in both the magnetic core and the sleeve, or by longitudinal bores in the magnetic core similar to the axial bore shown in FIG. 9.

Workpieces in the form of powdered metal compacts can be sintered by the above-described methods of heat treatment, and it is particularly advantageous in such sintering to control the heating levels in the early stages to allow heat to diffuse away from the hot spot areas at the particle interfaces. This can be achieved by a variation in the turn density on the induction coil. In a simple form of such a variation the induction coil can be formed as a series of short spaced-apart sections at and adjacent the entrance of the treatment region. It is also particularly advantageous in sintering of powdered metal compacts to vary the current in the induction coil, or in the spaced-apart sections when present, as a function of time in order to minimize the hot spots.

In one construction of magnetic cores, a mixture of 5% magnetite and 95% iron dust is isostatically compressed to the required shape. The magnetite provides electrical insulation between the iron particles to reduce eddy currents in the core. The relative magnetic permeability obtained by such pressed powder techniques is low (generally in the range 20 to 30) compared to that obtainable with silicon-iron laminations. As shown in FIG. 11, which is a cross-section through a flux modifier such as core 16 of FIG. 1, preferred method of obtaining a high permeability magnetic core is to form a multiplicity of lengths of fine magnetic wire 50 into a bundle and to secure the wires together by means of a ceramic cement 51 or some other non-conductive adhesive. The wire should have a high permeability and a low conductivity, and suitable materials presently available are found among resistance heating wires.

Whereas, as described above, the cores 16 and the elements for improving the flux distribution in workpieces are formed of magnetic material, i.e. material having a significant value of magnetic permeability, they can alternatively be formed of material having a low or insignificant value of permeability provided that it is electrically conductive and can effect modification of the flux distribution by means of the eddy current induced therein.

In the above-mentioned embodiments the workpieces are constrained to travel at predetermined positions along a transport means, for example on posts 28. One form of such a transport means is an endless belt conveyor system made of a stainless steel mesh. The various links of such a mesh belt are in practice electrically insulated from each other by a film of chromium oxide which forms on the surface of the stainless steel. Where it is desired to use a mesh belt for conveying the workpieces at predetermined positions, there may be provided posts of the kind shown in FIG. 3; these posts act as the above-mentioned flux modifying members and they can be attached to the mesh belt via a ceramic mounting device. As an alternative to the above-mentioned stainless steel mesh belt, an endless conveyor can be formed of ceramic elements linked together by for example stainless steel pins.

We claim:

1. A method of heat treating a rotationally symmetrical workpiece by induction heating comprising mounting the workpiece on a refractory transport means and passing the transport means longitudinally through an elongate treatment region of an induction heating apparatus with the axis of symmetry of the workpiece parallel to the magnetic flux of the induction heating apparatus, the workpiece being accompanied on at least part of its passage through the treatment region by at least one flux modifying member to modify the magnetic flux distribution in the workpiece wherein said flux modifying member is arranged so that, by the effects of the eddy currents induced in that member and/or its magnetic permeability, the resultant distribution across the workpiece transversely to the axis thereof of the flux density in the axial direction is substantially inversely related to the distance from the axis of rotational symmetry of the workpiece.

2. A method of heat treating rotationally symmetrical workpieces by induction heating comprising mounting the workpieces spaced apart along a refractory transport means and passing the transport means longitudinally through an elongate treatment region of an induction heating apparatus with the axis of symmetry of the workpieces parallel to the magnetic flux of the induction heating apparatus, there being a multiplicity of workpieces in the treatment region at any one time, each workpiece being accompanied on at least part of its passage through the treatment region by at least one flux modifying member which acts to modify the magnetic flux distribution wherein the flux modifying members are arranged so that, by the effects of the eddy currents induced in those members and/or their magnetic permeability, the resultant distribution across the workpiece transversely to the axis thereof of the flux density in the axial direction is substantially inversely related to the distance from the axis of rotational symmetry of the workpiece.

3. A method as claimed in claim 2 wherein the workpieces are spaced apart by the use of spacers.

4. A method as claimed in claim 3 wherein the spacers are non-conductive.

5. A method as claimed in claim 2 wherein the transport means is arranged to carry the workpieces at predetermined spaced positions.

6. A method as claimed in claim 5 wherein the transport means comprises a multiplicity of non-conductive elements fitting together in a line, and formed so as to provide respective cavities in which the workpieces are disposed.

7. A method as claimed in claim 5 wherein the heating coil of the apparatus is of the flat-coil type and is elongate, the treatment region being that region between the spaced elongate portions of the coil, and in that the transport means comprises a movable body of non-conductive material including mounting means arranged to mount workpieces at predetermined spaced-apart positions.

8. A method as claimed in claim 7 wherein the workpieces have a cavity or a through passage, and the mounting means comprises respective posts which may be fixed to the body or located within respective recesses in the body.

9. A method as claimed in claim 7 wherein the workpieces are rotated as they move through the treatment region.

10. A method as claimed in claim 1 wherein the flux modifying members are made of a magnetic material having high electrical resistivity.

11. A method as claimed in claim 1 wherein the flux modifying members are made of an electrically conductive material.

12. A method as claimed in claim 10 wherein the flux modifying members are formed using a pressed powder technique.

13. A method as claimed in claim 12 wherein the flux modifying members are formed of iron dust.

14. A method as claimed in claim 10 wherein the flux modifying members have been made by the steps of forming a bundle of strands of a high permeability/low conductance material and filling the interstices of the bundle with a non-conducting substance to hold the strands in position.

15. A method as claimed in claim 1 including providing thermally insulating material between the workpiece and the magnetic flux modifying members.

16. A method as claimed in claim 1 including cooling the flux modifying members by passing a coolant through and/or over the members.

17. A method as claimed in claim 1 wherein the workpiece has a central bore and the total quantity of flux in the bore is equivalent to a constant flux density across the bore equal to twice the value of flux density at the wall of the bore.

18. An induction heating apparatus for the heat treatment of a rotationally symmetrical workpiece passed through an elongate treatment region thereof, comprising a refractory transport means movable longitudinally through the treatment region, said transport means being arranged to carry the workpiece with its axis of symmetry in a predetermined direction with respect to the transport means, means for producing an alternating magnetic flux in said treatment region with the flux parallel to the axis of symmetry of the workpiece and flux modifying members arranged to accompany the workpiece in predetermined positions with respect thereto on at least part of its passage through the treatment region, wherein said modifying members are shaped and arranged to modify the flux in the treatment region by the effects of the eddy currents induced in said members and/or their magnetic permeability so that the resultant distribution across the workpiece transversely to the axis thereof of the flux density in the axial direction is substantially inversely related to the distance from the axis of rotational symmetry of the workpiece.

19. An induction heating apparatus for the heat treatment of rotationally symmetrical workpieces passed sequentially through an elongate treatment region thereof, comprising a refractory transport means movable longitudinally through the treatment region and along which the workpieces can be spaced, said transport means being arranged to carry each workpiece with its axis of symmetry in a predetermined direction with respect to the transport means, means for producing an alternating magnetic flux in said treatment region with the flux parallel to the axis of symmetry of the workpiece and flux modifying members arranged to accompany workpieces in predetermined positions with respect thereto on at least part of their passage through the treatment region, wherein said modifying members are shaped and arranged to modify the flux in the treatment region by the effects of the eddy currents induced in said members and/or their magnetic permeability so that for each workpiece the resultant distribution across the workpiece transversely to the axis thereof of the magnetic flux density in the axial direction is substantially inversely related to the distance from the axis of rotational symmetry of the workpiece.

20. An apparatus as claimed in claim 19 wherein the heating coil of the apparatus to produce said flux is of the flat-coil type and is elongate, the treatment region being that region between the spaced elongate portions of the coil, and wherein the transport means comprises a movable body of non-conductive material including mounting means arranged to mount workpieces at predetermined spaced-apart positions.

21. An apparatus as claimed in claim 20 wherein the mounting means comprises respective posts fixed to the body or located within respective recesses in the body and constituting the flux modifying members.

22. An apparatus as claimed in claim 18 wherein the flux modifying members are made of a magnetic material having high electrical resistivity.

23. An apparatus as claimed in claim 18 werein the flux modifying members are made of an electrically conductive material.

24. An apparatus as claimed in claim 18 wherein the flux modifying members have been formed using a pressed powder technique.

25. An apparatus as claimed in claim 24 wherein the flux modifying members are formed of iron dust mixed with magnetite.

26. An apparatus as claimed in claim 22 wherein the flux modifying members are in the form of a multiplicity of strands of a high permeability/low conductance material securely held together in a bundle by a non-conductive encapsulant.

27. An apparatus as claimed in claim 20 and means for rotating the workpiece about its axis of symmetry as it moves through the treatment region.

* * * * *